US011641902B2

(12) United States Patent
Zarreii

(10) Patent No.: US 11,641,902 B2
(45) Date of Patent: May 9, 2023

(54) CONCUSSION REDUCING/ENERGY TRANSFERRING HELMET AND SHOULDER SYSTEM

(71) Applicant: Mansour Zarreii, Mechanicsburg, PA (US)

(72) Inventor: Mansour Zarreii, Mechanicsburg, PA (US)

( * ) Notice: Subject to any disclaimer, the term of this patent is extended or adjusted under 35 U.S.C. 154(b) by 190 days.

(21) Appl. No.: 17/128,339

(22) Filed: Dec. 21, 2020

(65) Prior Publication Data

US 2021/0106090 A1 Apr. 15, 2021

Related U.S. Application Data

(63) Continuation-in-part of application No. 16/003,151, filed on Jun. 8, 2018, now abandoned.

(60) Provisional application No. 62/519,315, filed on Jun. 14, 2017.

(51) Int. Cl.

| | |
|---|---|
| ***A42B 3/04*** | (2006.01) |
| ***A42B 3/06*** | (2006.01) |
| ***A42B 3/12*** | (2006.01) |

(52) U.S. Cl.

CPC ..... *A42B 3/0473* (2013.01); *A42B 3/064* (2013.01); *A42B 3/121* (2013.01)

(58) Field of Classification Search

CPC ..... A42B 3/0473; A42B 3/064; A42B 3/121
See application file for complete search history.

(56) References Cited

U.S. PATENT DOCUMENTS

| | | | | |
|---|---|---|---|---|
| 3,134,106 | A * | 5/1964 | Shaffer | A42B 3/0473 2/468 |
| 3,189,917 | A * | 6/1965 | Sims | A63B 71/10 2/415 |
| 4,638,510 | A * | 1/1987 | Hubbard | B60N 2/80 2/6.1 |
| 4,821,339 | A * | 4/1989 | Fair | A41D 13/0153 2/908 |
| 4,825,476 | A * | 5/1989 | Andrews | A63B 71/12 2/468 |
| 4,996,720 | A * | 3/1991 | Fair | A63B 71/12 2/92 |
| 5,204,998 | A * | 4/1993 | Liu | F16F 1/3732 2/425 |
| 5,390,367 | A | 2/1995 | Rush, III | |
| 5,404,590 | A * | 4/1995 | Monica, Jr. | A63B 71/1291 2/468 |
| 5,493,736 | A * | 2/1996 | Allison | A42B 3/0473 2/416 |
| 5,546,601 | A | 8/1996 | Abeyte | |

(Continued)

OTHER PUBLICATIONS

Office Action for U.S. Appl. No. 16/003,151, dated Apr. 7, 2020.
Final Office Action for U.S. Appl. No. 16/003,151, dated Sep. 21, 2020.

*Primary Examiner* — Khaled Annis
(74) *Attorney, Agent, or Firm* — Joseph E. Maenner; Maenner & Associates, LLC

(57) ABSTRACT

A head protection device includes a head cradle portion and a force transfer/energy absorbing collar portion. The head cradle portion is spaced from adjacent and out of contact with the collar portion in normal operation and in contact with the collar portion upon impact of predetermined force, transferring the force and associated energy around the head cradle portion and dissipating the energy.

18 Claims, 14 Drawing Sheets

(56) References Cited

U.S. PATENT DOCUMENTS 5,546,609 A * 8/1996 Rush, III ..... A41D 13/018 455/100
5,930,843 A * 8/1999 Kelly ..... A42B 3/0473 2/468
6,052,835 A * 4/2000 O'Shea ..... A42B 3/0473 2/468
6,067,665 A * 5/2000 DePalma ..... A63B 71/1291 2/468
6,182,300 B1 2/2001 Severance
6,253,389 B1 * 7/2001 Scaglione ..... A41D 13/0518 2/463
6,591,430 B1 * 7/2003 Sledge ..... A42B 3/0473 2/468
7,155,747 B2 * 1/2007 Baker ..... A42B 3/0473 2/421
3,162,865 A1 4/2012 Mazzarolo
8,321,965 B2 * 12/2012 Newman ..... A42B 3/0473 2/468
8,370,968 B2 * 2/2013 Kerr ..... A41D 13/0531 2/459
8,566,967 B2 * 10/2013 Janisse ..... A42B 3/0473 2/411
9,388,873 B1 * 7/2016 Phipps ..... F16F 3/04
9,462,841 B1 * 10/2016 Popejoy ..... A42B 3/0473
9,861,152 B1 * 1/2018 Rumfelt ..... A63B 71/12
2004/0128744 A1 * 7/2004 Cleveland ..... A41D 13/0512 2/425
2004/0216206 A1 * 11/2004 Schroth ..... A42B 3/0473 2/459
2007/0010771 A1 * 1/2007 Leatt ..... A42B 3/0473 602/18
2007/0151004 A1 * 7/2007 Brassill ..... A63B 71/12 2/461
2010/0088808 A1 * 4/2010 Rietdyk ..... A42B 3/0473 2/467
2010/0088809 A1 * 4/2010 Leatt ..... A61F 5/055 2/468
2010/0263110 A1 * 10/2010 Berry ..... A42B 3/0473 2/459
2012/0278980 A1 * 11/2012 Chuback ..... A41D 13/0512 2/461
2012/0291189 A1 * 11/2012 Chambers ..... A61F 5/055 2/468
2013/0036538 A1 * 2/2013 Sheren ..... A41D 13/0512 2/463
2014/0020163 A1 * 1/2014 Stiles ..... A61F 5/055 2/468
2015/0208750 A1 * 7/2015 White ..... A41D 13/015 2/462
2015/0208751 A1 * 7/2015 Day ..... A42B 3/124 2/414
2016/0120238 A1 * 5/2016 Duncan ..... A63B 71/1291 2/462
2016/0213086 A1 * 7/2016 Nagely ..... A41D 13/0531
2016/0366967 A1 * 12/2016 Jinkins ..... A42B 3/0473
2017/0056753 A1 * 3/2017 Kerr ..... A42B 3/0473
2017/0065016 A1 * 3/2017 Chuback ..... A42B 3/0473
2017/0251742 A1 * 9/2017 Partlo ..... A42B 3/0473
2017/0266536 A1 * 9/2017 Sciortino ..... A42B 3/0473
2017/0318889 A1 * 11/2017 Nagely ..... A42B 3/0473
2018/0228239 A1 * 8/2018 Day ..... F16F 1/126
2018/0255861 A1 * 9/2018 Ho ..... A42B 3/063
2018/0343937 A1 * 12/2018 Pilon ..... A41D 13/0512
2021/0106090 A1 * 4/2021 Zarreii ..... A42B 3/064

* cited by examiner

CONCUSSION REDUCING/ENERGY TRANSFERRING HELMET AND SHOULDER SYSTEM

CROSS-REFERENCE TO RELATED APPLICATION

The present application is a continuation-in-part of U.S. patent application Ser. No. 16/003,151, filed on Jun. 8, 2018, which claims priority form U.S. Provisional Patent Application Ser. No. 62/519,315, filed on Jun. 14, 2017, which is incorporated herein by reference in its entirety.

BACKGROUND OF THE INVENTION

There are many studies done on causes of concussion in contact sports. Many attempts have been made on systems to reduce the felt forces of a head on impact by the brain. Unfortunately none of these solutions has yielded great results on prevention of concussions.

One reason for these failures in design is the amount of forces that needs to be dissipated by the head and the brain can reach in access of 1,600 ft/lbs. Upon an impact, the weight of the brain immersed in the fluid filled skull would have to oscillate back and forth until all the impact's residual forces are dissipated. The number of oscillation of the brain inside the skull is a direct result of the sum of forces received in a head on impact. The higher the force, the higher the number of brain oscillations and the greater the damage. The severity of resulting concussion is directly related to the number of times that the brain has to oscillate back and forth (resonance of the brain).

Almost all concussion patients show a decreased level of visual ocular motor responsiveness regardless of what direction their head was hit. These visual ocular motor responsiveness deficiencies are a good indication and a measure of severity of the damage done to the brain as a result of a concussion.

Any system that can reduce the felt forces by the brain will reduce the number of oscillations of the brain and thereby reduce the severity of the damage to the brain and the severity of any resultant concussion. Since concussion does not have a cure at this time, it is much better to receive forces with muscular and skeletal parts of the body than the brain. Muscular and skeletal body parts if they are damaged, they can be successfully repaired with many techniques available today. This would be a better choice for receiving the impact forces than receiving multiple concussions that can have a terrible long term effect on a player (Alzheimer's, Dementia, ALS, Etc.)

What is needed is a device that will reduce the forces transmitted to the head and dissipate the energy absorbed by the head and brain.

BRIEF SUMMARY OF THE INVENTION

This Summary is provided to introduce a selection of concepts in a simplified form that are further described below in the Detailed Description. This summary is not intended to identify key features or essential features of the claimed subject matter, nor is it intended to be used to limit the scope of the claimed subject matter.

The present invention is a device that transmits forces through a head cradle portion and transfers the forces and the energy to the body, dissipating energy that is transferred to the body. A head protection assembly device transfers forces and associated energy away from the head comprises a head cradle portion, an energy absorbing collar portion spaced from and adjacent to the head cradle portion. The energy absorbing collar portion may further comprise a shoulder portion and/or a body fitting portion. The helmet and shoulder system will divert the bulk of the forces and associated energy (including rotational) of a hard impact received by the player's helmet and head to the players body away from the head, such as to the shoulders. Once the impact forces of predetermine load and associated energy are directed to the user's shoulders, they are mostly dissipated and will not be available to reflect back to the head and oscillate the user's brain while damping. As used herein, the term user is used interchangeably with a player, a soldier or any other person utilizing the device for purposes of transferring forces from the head to the body so as to dissipate energy from a force applied to the head.

The helmet and shoulder system will substantially reduce the number of brain oscillations as compare to existing helmet designs that rely on the helmet and the players head to dissipate all the energy from a hard impact.

In fact the helmet and shoulder system of the present invention will make the majority of the impact forces to travel around the brain, the energy being transferred to the body and dissipated by, for example, the shoulders. This system does not replace current equipment and is meant to be used when possible with existing equipment, such as being combined with current helmet and shoulder pad designs so that it can be used to greatly reduce the severity of concussions in most contact sports such as football, hockey, lacrosse and other sports where there are impacts at high speeds. The device may also be useful to soldiers or other military personnel who are subject to injury from percussions due to exploding ordnance.

The purpose of the head protection assembly device is to transfer energy from a blow to the head of predetermined force from the head to the collar portion, where the energy may be quickly dissipated by being transferred to the shoulder portion of body-fitting portion instead of being damped by repeated oscillations of the head as in current and prior art designs. The head protection assembly device thus reduces movement of the head and corresponding oscillations of the brain when subjected to a blow of predetermined force. The head protection assembly device does not have to reduce minor impacts that are of no consequence to the user, but only impacts that are at or above a critical force value.

The head cradle portion includes a lower section that is independent of the energy absorbing collar portion. The head cradle portion moves independently of the energy absorbing collar portion. In one embodiment, the head cradle portion is spaced from the collar portion. However, the head protection assembly is not so restricted and may be connected at one or more locations to the collar portion. However, if so connected, the head cradle portion can move independently of the collar portion, that is to say that the collar portion and the head cradle portion do not necessarily interfere with the movement of the other.

The energy absorbing collar portion absorbs energy transferred from the head cradle portion due to motion of head cradle portion resulting from an impact, such as for example from a blow from another person or from an object. The energy absorbing collar may comprise any energy absorbing material that can receive and damp energy thereby reducing oscillations of the head due to the impact. The energy absorbing collar may comprise a gel or foam. However, any other energy absorbing material may be used, including but not limited to thixotropic materials or newly discovered materials that are being used by the Air Force in ballistic vests. When used in a military application, the Air Force material will also provide the head cradle portion a certain ballistic resistance. For reduced weight, air bags comprising light weight plastic such as polyethylene sealed and filled with air may be used.

BRIEF DESCRIPTION OF THE DRAWINGS

The accompanying drawings, which are incorporated herein and constitute part of this specification, illustrate the presently preferred embodiments of the invention, and, together with the general description given above and the detailed description given below, serve to explain the features of the invention. In the drawings.

DETAILED DESCRIPTION OF THE INVENTION

Figure 1:
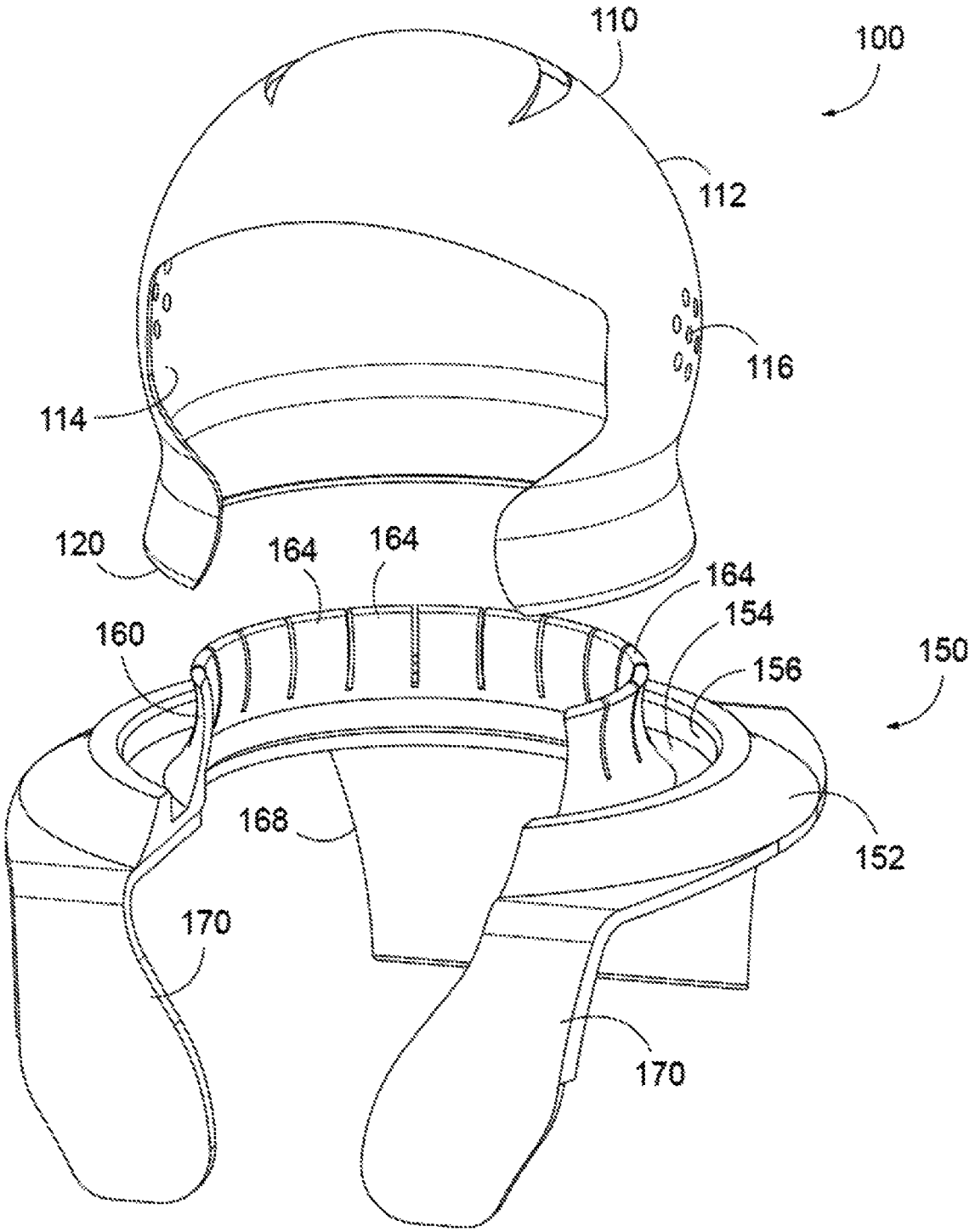
FIG. 1 is an exploded perspective view of depict an energy absorbing head protection assembly device according to a first exemplary embodiment of the present invention.

In the drawings, like numerals indicate like elements throughout. Certain terminology is used herein for convenience only and is not to be taken as a limitation on the present invention. The terminology includes the words specifically mentioned, derivatives thereof and words of similar import. As used herein, the term "event" is used to mean an occasion or experience that changes a subject's brain or neurological status from one condition to another. Such an "event" can be a blow to the head, possibly resulting in a concussion; a stroke or a mini-stroke; or other such experience that changes brain and/or other neurological functioning.

The embodiments illustrated below are not intended to be exhaustive or to limit the invention to the precise form disclosed. These embodiments are chosen and described to best explain the principle of the invention and its application and practical use and to enable others skilled in the art to best utilize the invention.

Reference herein to "one embodiment" or "an embodiment" means that a particular feature, structure, or characteristic described in connection with the embodiment can be included in at least one embodiment of the invention. The appearances of the phrase "in one embodiment" in various places in the specification are not necessarily all referring to the same embodiment, nor are separate or alternative embodiments necessarily mutually exclusive of other embodiments. The same applies to the term "implementation."

As used in this application, the word "exemplary" is used herein to mean serving as an example, instance, or illustration. Any aspect or design described herein as "exemplary" is not necessarily to be construed as preferred or advantageous over other aspects or designs. Rather, use of the word exemplary is intended to present concepts in a concrete fashion.

Additionally, the term "or" is intended to mean an inclusive "or" rather than an exclusive "or". That is, unless specified otherwise, or clear from context, "X employs A or B" is intended to mean any of the natural inclusive permutations. That is, if X employs A; X employs B; or X employs both A and B, then "X employs A or B" is satisfied under any of the foregoing instances. In addition, the articles "a" and "an" as used in this application and the appended claims should generally be construed to mean "one or more" unless specified otherwise or clear from context to be directed to a singular form.

Unless explicitly stated otherwise, each numerical value and range should be interpreted as being approximate as if the word "about" or "approximately" preceded the value of the value or range.

The use of figure numbers and/or figure reference labels in the claims is intended to identify one or more possible embodiments of the claimed subject matter in order to facilitate the interpretation of the claims. Such use is not to be construed as necessarily limiting the scope of those claims to the embodiments shown in the corresponding figures.

It should be understood that the steps of the exemplary methods set forth herein are not necessarily required to be performed in the order described, and the order of the steps of such methods should be understood to be merely exemplary. Likewise, additional steps may be included in such methods, and certain steps may be omitted or combined, in methods consistent with various embodiments of the present invention.

The head cradle portion, since it is not the primary method of energy absorption or energy dissipation, but rather a force and energy transfer device, may be made lighter. However, since the head cradle portion is the primary receiver of the impact, some absorbing material such as air bags, gel or foam should be used. It is believed that the head cradle portion may be made lighter, if desired, since it is no longer the primary energy damping system. The head cradle portion includes a lower portion primarily responsible for transferring energy from an impact from the head cradle portion to the energy absorbing collar portion.

The collar portion may comprise a body portion and/or a shoulder portion. These may comprise a gel, a foam, air bags or some other energy absorbing material.

Figure 2:
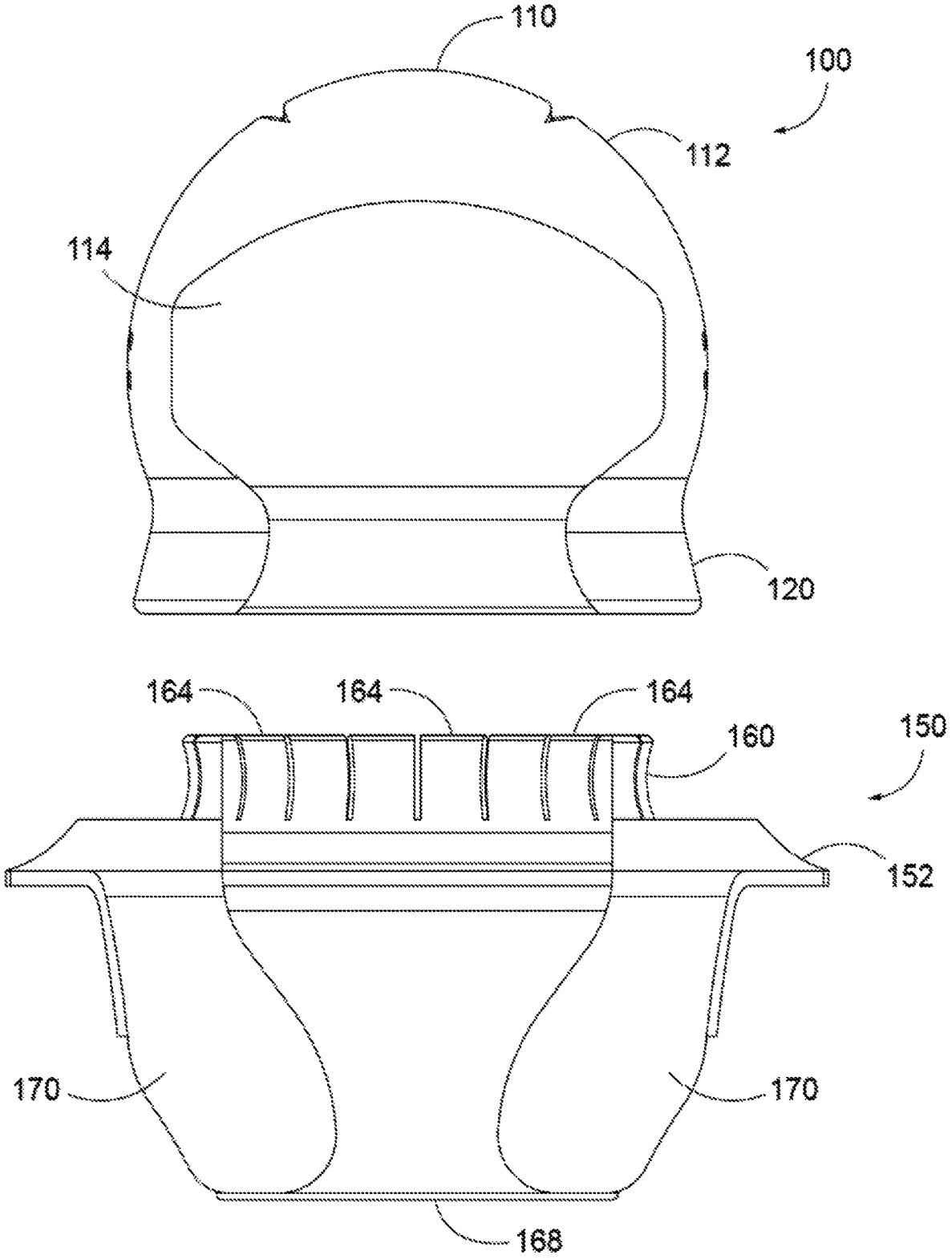
FIG. 2 is a front elevational view of the device of FIG. 1.

FIGS. 1 and 2 depict an energy absorbing head protection assembly device 100 ("device 100") according to a first exemplary embodiment of the present invention. The device 100 comprises a head cradle portion 110 and an energy absorbing collar portion 150. The head cradle portion 110 has a lower section 112 that interfaces with energy absorbing collar portion 150. Head cradle portion 110 is spaced from adjacent and out of contact with the collar portion 150 in normal operation and in contact with the collar portion 150 upon impact of predetermined force, transferring the force and associated energy around the head cradle portion 110 and dissipating the energy.

Head cradle portion 110 includes a generally spherical upper portion 112 having an open face portion 114 with a plurality of through openings 116 on either side of open face portion 114. A flange 120 is connected to the upper portion 112 and extends in an arcuate direction around the upper portion 112.

The collar portion 150 comprises a shoulder portion 152 extending outwardly therefrom. Shoulder portion 152 includes a seat 154 extending in an arc of at least 180 degrees around shoulder portion 152. Seat 152 receives an impact from flange 120 to distribute the force of an impact on head cradle portion 110 to collar portion 150.

The shoulder portion 152 extends outwardly from the seat 154. A rim 156 extends upwardly from seat 154 outside the arc. Rim 156 is angled inwardly toward the center of the arc to keep flange 120 within the perimeter defined by rim 156.

A sleeve 160 extends upwardly from the seat 154 within the arc. The sleeve 160 is located within a perimeter defined by the flange 120. Sleeve 160 comprises a plurality of segments 164. The plurality of segments 164 allow the sleeve 160 to move inwardly or outwardly, thereby absorbing at least some of the energy imparted onto sleeve 160.

A rear body portion 168 extends downwardly from shoulder portion 152 to the rear of collar portion 150 while two forward body portions 168 extend downwardly from shoulder portion 152.

Device 100 allows a player to have a complete freedom to move his/her head during the normal conditions of a game. Device 100 limits the amount of compression and extension distance of the player's head versus the player's shoulder regardless of which direction the hit comes from. After device 100 is engaged, the player will feel more of the force received by the shoulders, which are much stronger than the head.

Figure 3:
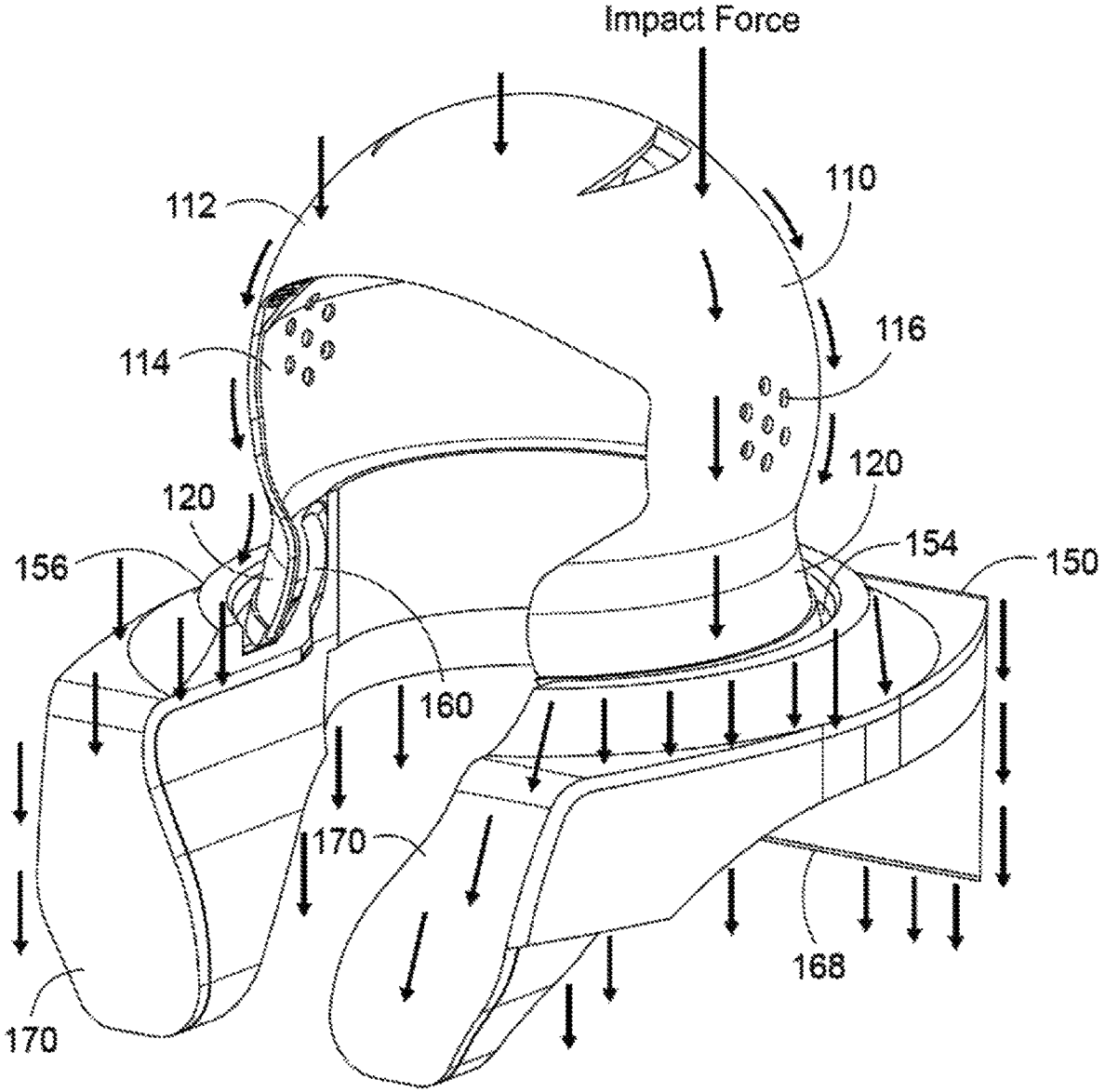
FIG. 3 is a perspective view of the device of FIG. 1, showing force arrows pushing downward on the head cradle portion of the device.
Figure 4:
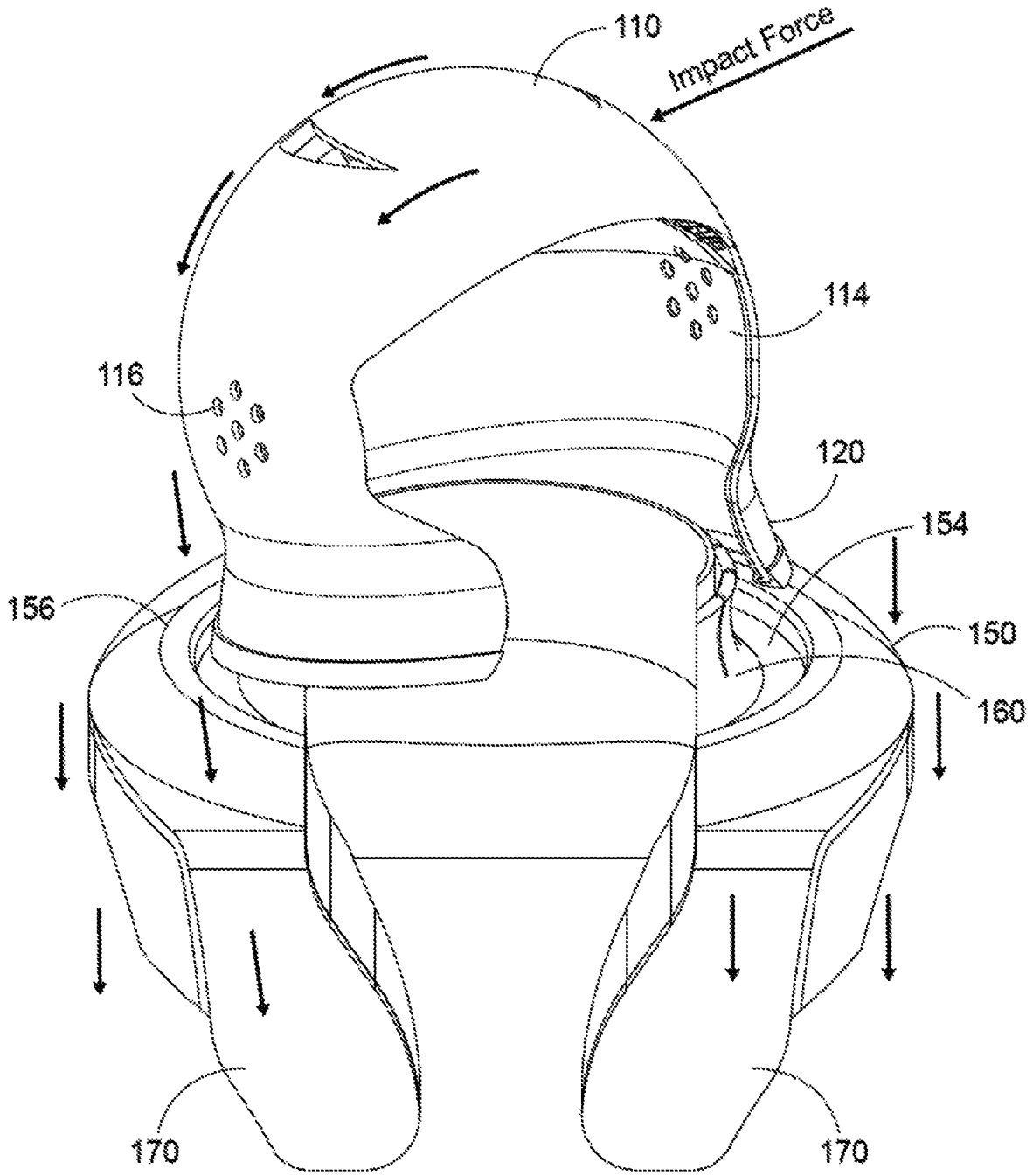
FIG. 4 is a perspective view of the device of FIG. 1, showing force arrows pushing obliquely on the head cradle portion of the device.
Figure 5:
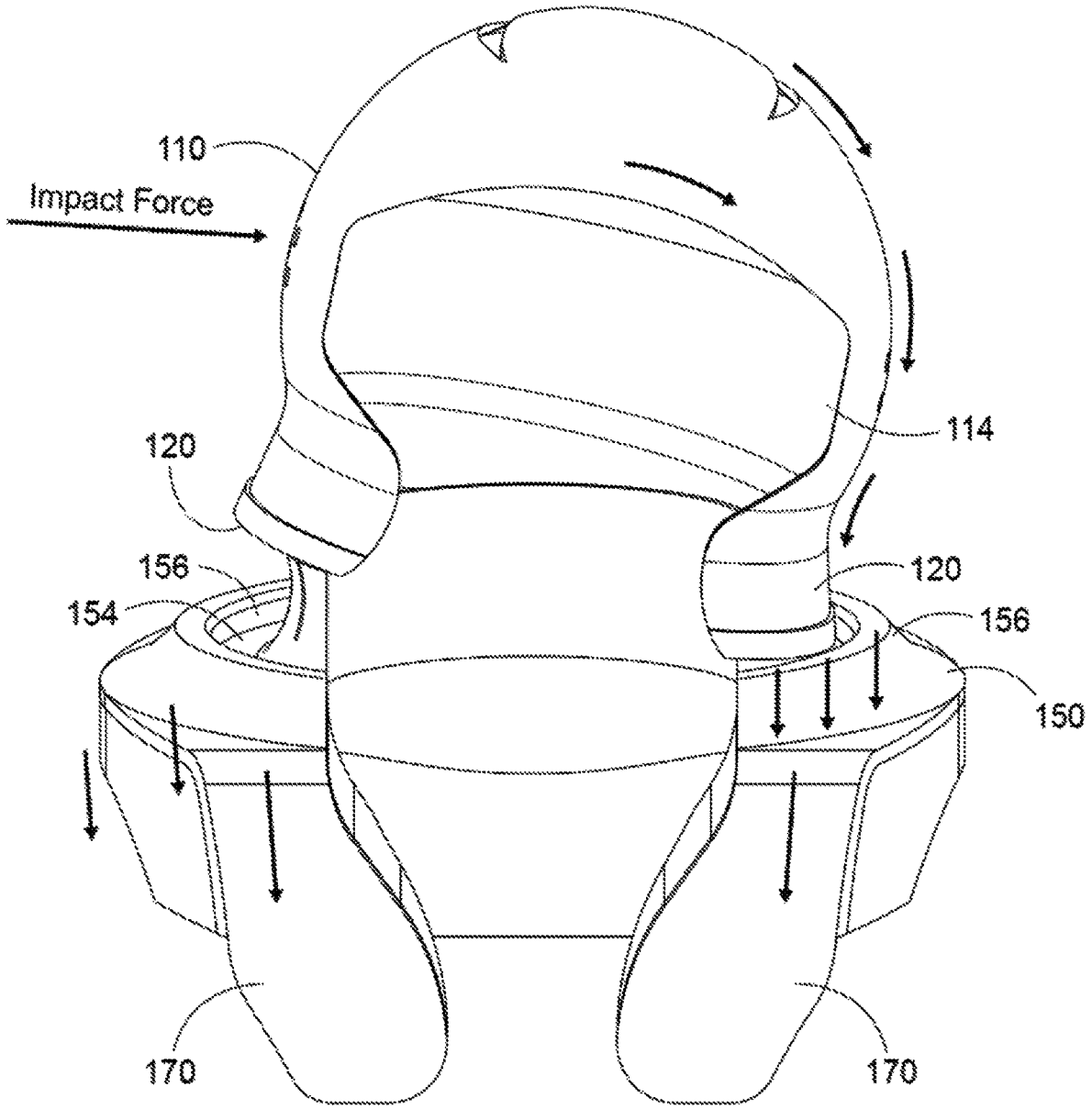
FIG. 5 is a perspective view of the device of FIG. 1, showing force arrows pushing sideways on the head cradle portion of the device.
Figure 6:
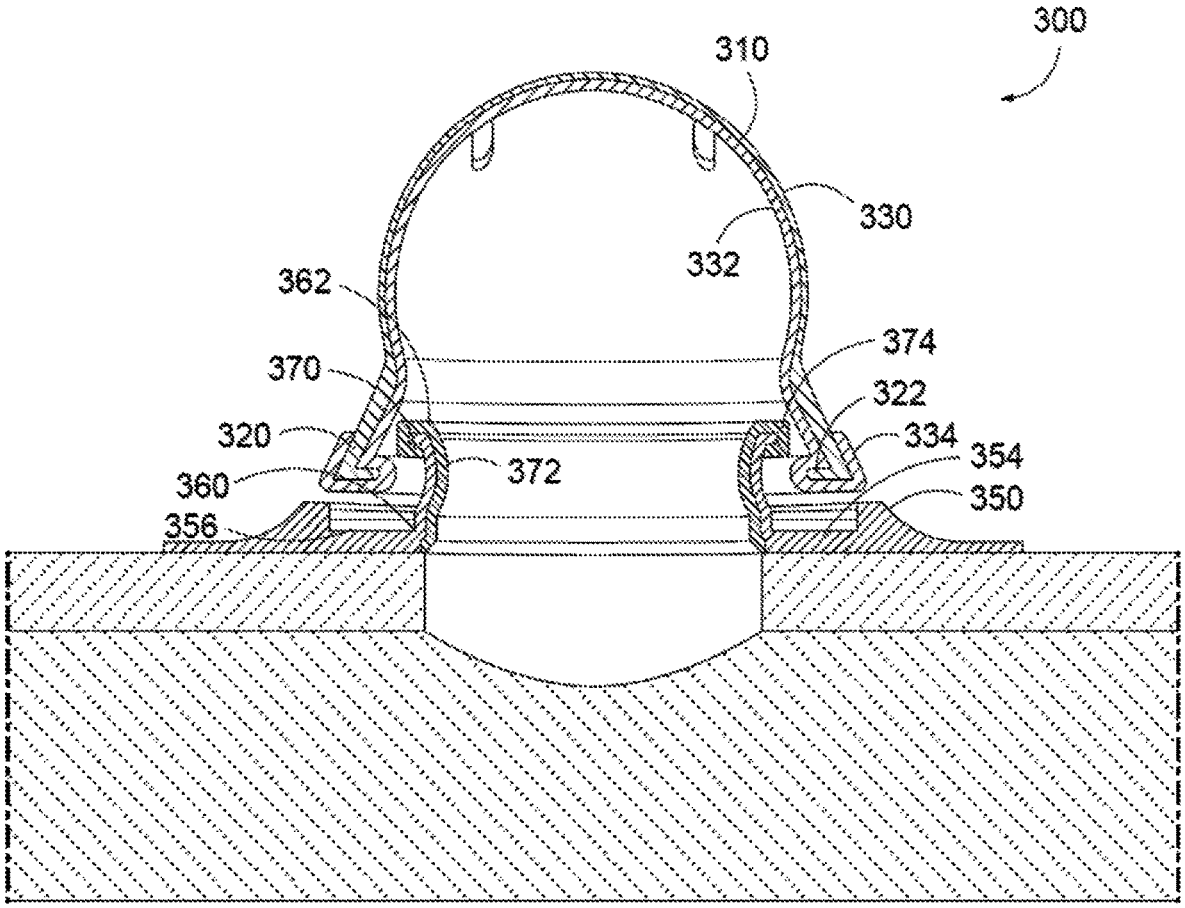
FIG. 6 is a front elevational view, in section of an energy absorbing head protection assembly device according to an alternative exemplary embodiment of the present invention.
Figure 7:
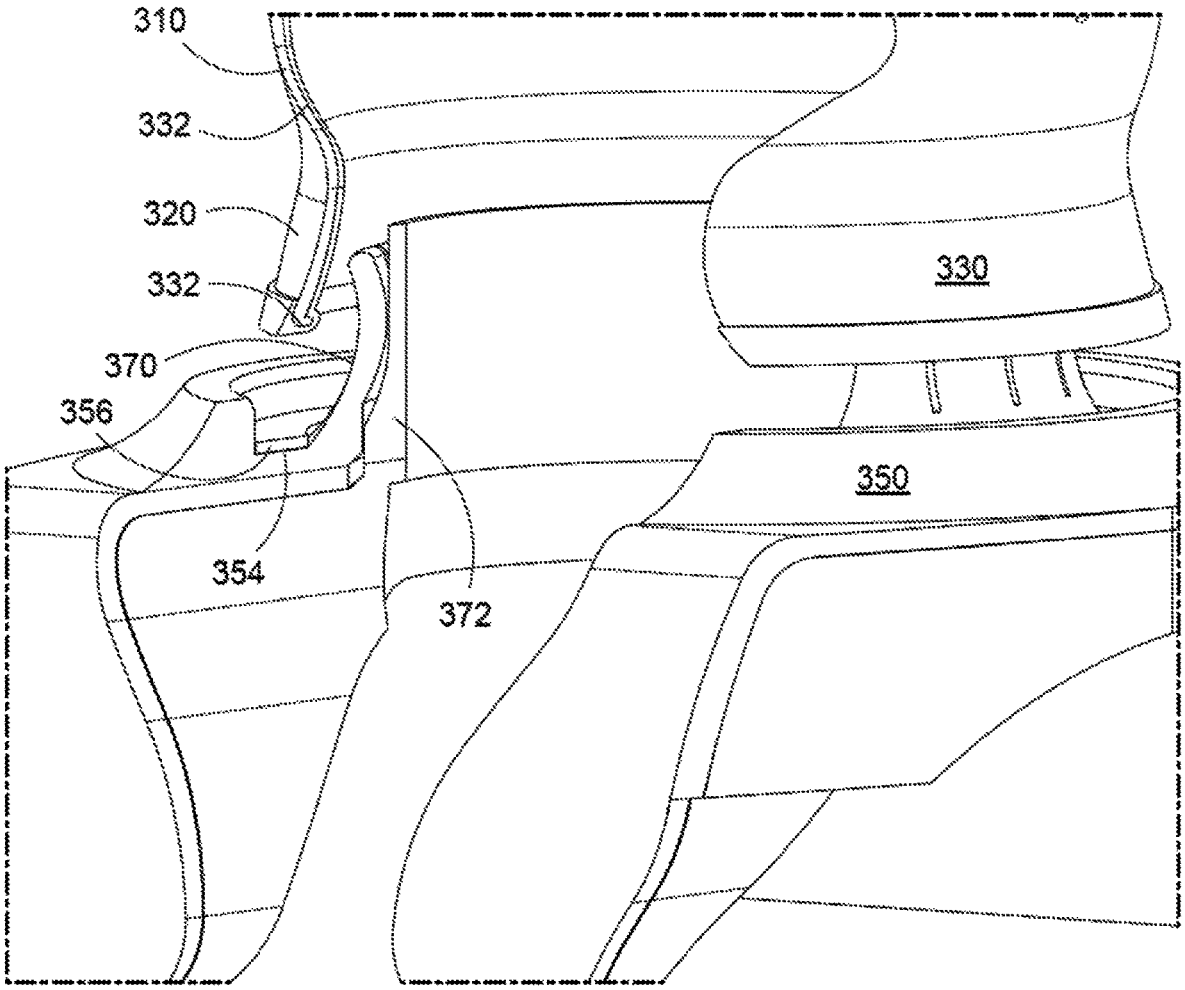
FIG. 7 is an enlarged perspective view showing an interface between a head cradle portion and a collar portion of the device of FIG. 6'
Figure 8:
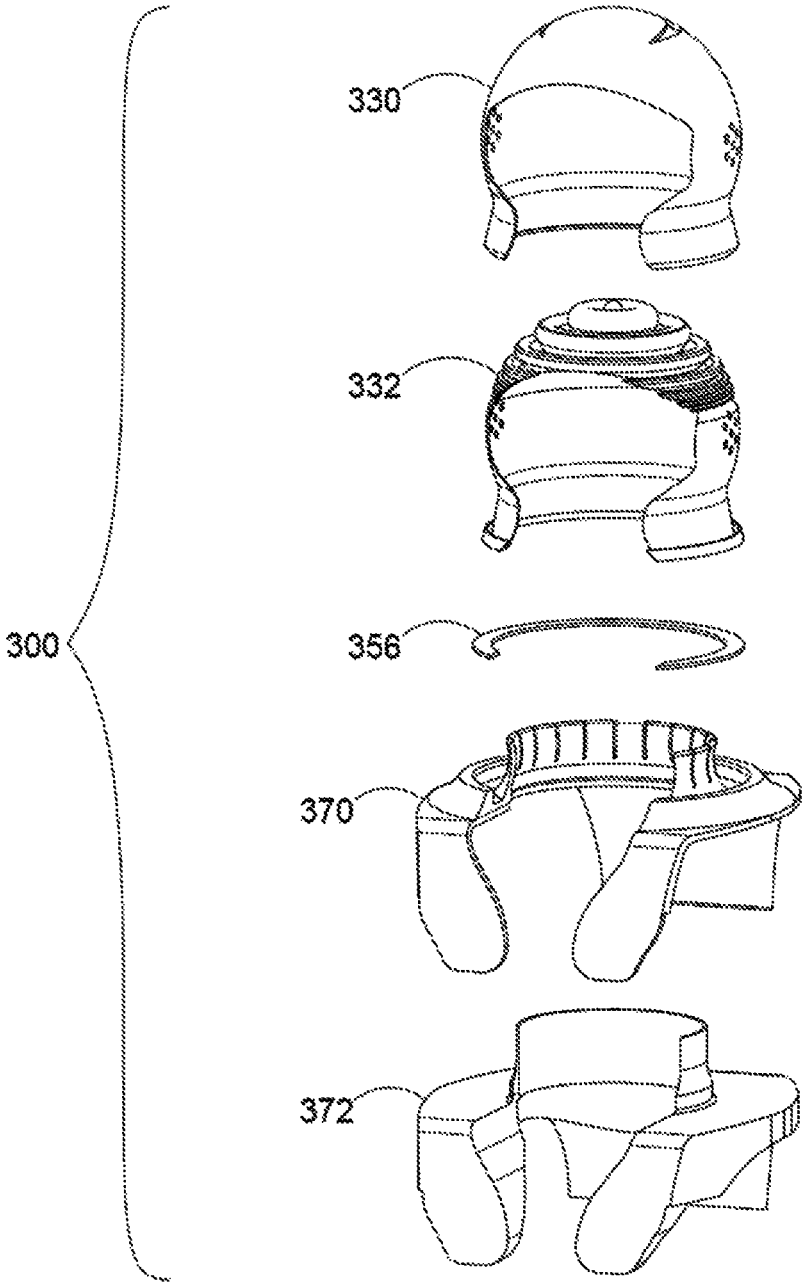
FIG. 8 is an exploded perspective view of the device of FIG. 6.
Figure 9:
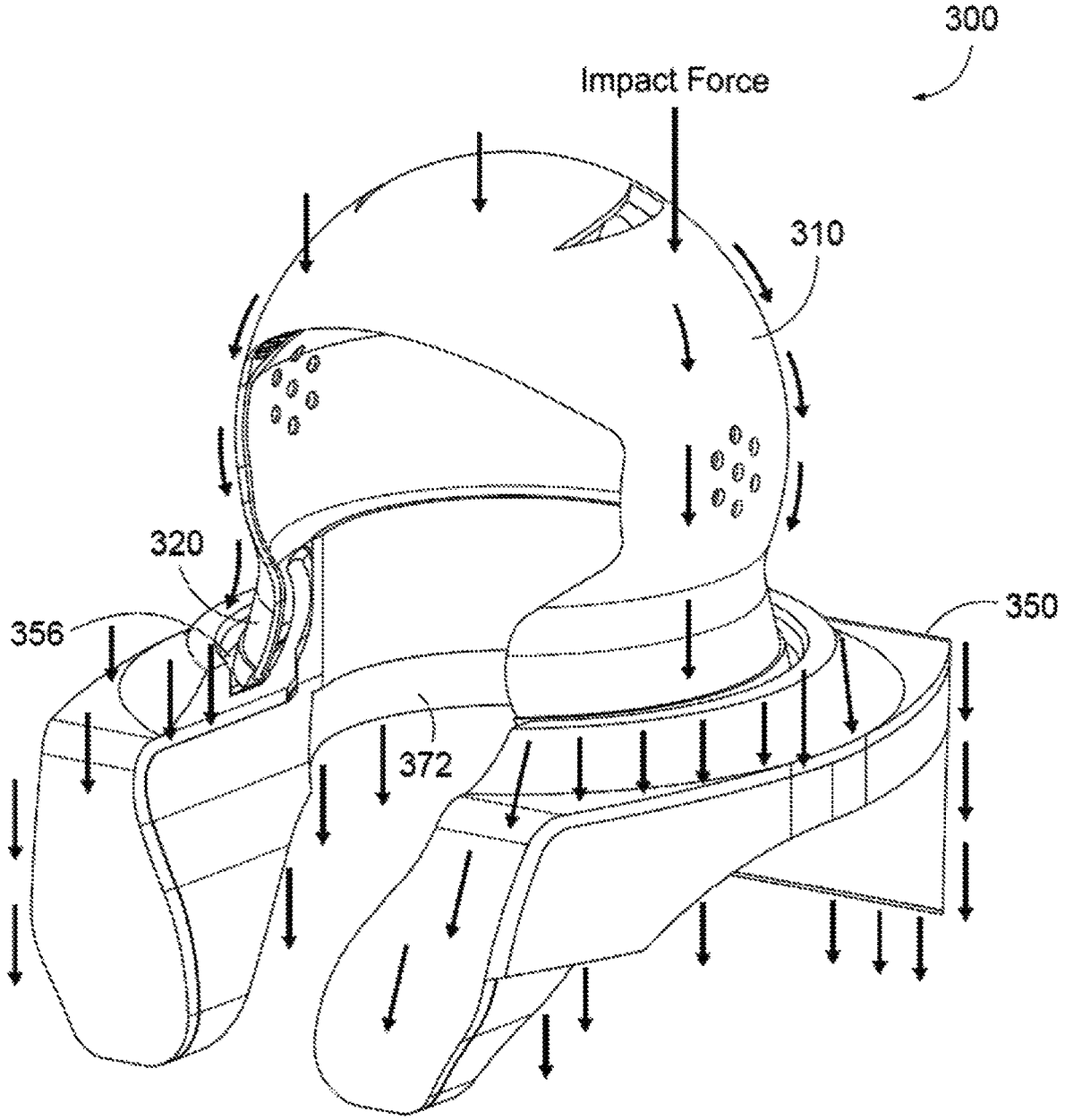
FIG. 9 is a perspective view of the device of FIG. 6, showing force arrows pushing downward on the head cradle portion of the device.
Figure 10:
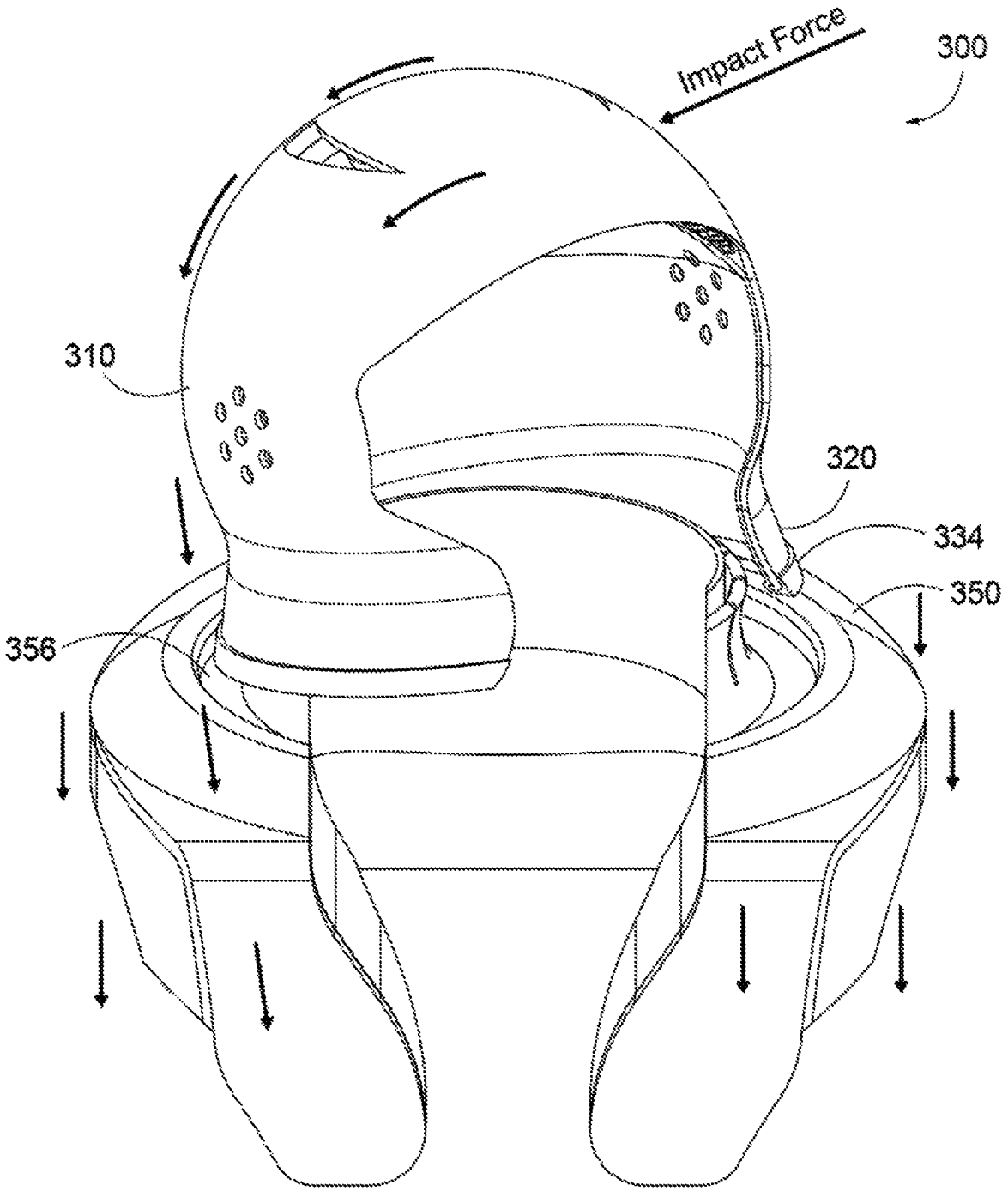
FIG. 10 is a perspective view of the device of FIG. 6, showing force arrows pushing obliquely on the head cradle portion of the device.

During an impact, device 100 engages head cradle portion 110 to collar portion 150 to dampen and transfer forces to the shoulders and significantly reduce the resonance of the brain. FIG. 3 shows an exemplary schematic of how a force (shown by arrows) directed vertically downward onto head cradle portion 110 is imparted onto collar portion 150. Similarly, FIG. 4 shows an exemplary schematic of how a force (shown by arrows) directed obliquely onto head cradle portion 110 is imparted onto collar portion 150 and FIG. 5 shows an exemplary schematic of how a force (shown by arrows) directed from the side onto head cradle portion 110 is imparted onto collar portion 150.

While head cradle portion 110 is free to move independently of collar portion 150, any rapid downward or sideward movement of the head such as may result from an impact causes flange 120 to impact seat 154, transferring energy from head cradle portion 110 to collar portion 150 where the energy can be dissipated.

In an alternative embodiment, as shown in FIGS. 6-10, an energy absorbing head protection assembly device 300 ("device 300") includes a head cradle portion 310 having an upper portion 312 and a flange 320. Upper portion 312 comprises an outer shell 330 and an inner shell 332 having a lip 334 wrapped around a portion of the outer shell 330. Inner shell 332 can be an energy absorbing material such as a gel or other force dampening/energy absorbing material such as Sorbothane.

The gel extends down to and encompasses a flange 320 that extends downwardly from upper portion 312. Flange 320 flares outwardly from the upper portion 312 and includes a flange rib 322 extending radially inwardly.

A collar portion 350 includes a sleeve 360 that has an outer sleeve 370 fixedly connected to a seat 354 and an inner sleeve 372 having a lip 374 wrapped around a top portion of the outer sleeve 370. Seat 354 can include an energy absorbing material 356 mounted on or attached to the seat 354. Material 356 can be Sorbothane, D30, or other energy absorbing material. The sleeve 360 comprises a sleeve rib 362 extending radially outwardly above the flange rib 322.

In an alternative embodiment of an energy absorbing head protection assembly device 400 ("device 400"), shown in FIGS. 11-14, a head cradle portion 410 includes an inner shell 432 located within the head cradle portion 410. The inner shell 432 includes a compressive barrier 434 in the form of a plurality of energy absorbing devices 434 located between the inner shell 432 and the head cradle portion 410, and in engagement with the head cradle portion 430. The energy absorbing device 434 can be columns of Sorbothane, D30, or other energy absorbing material to control rotational forces.

Figure 11:
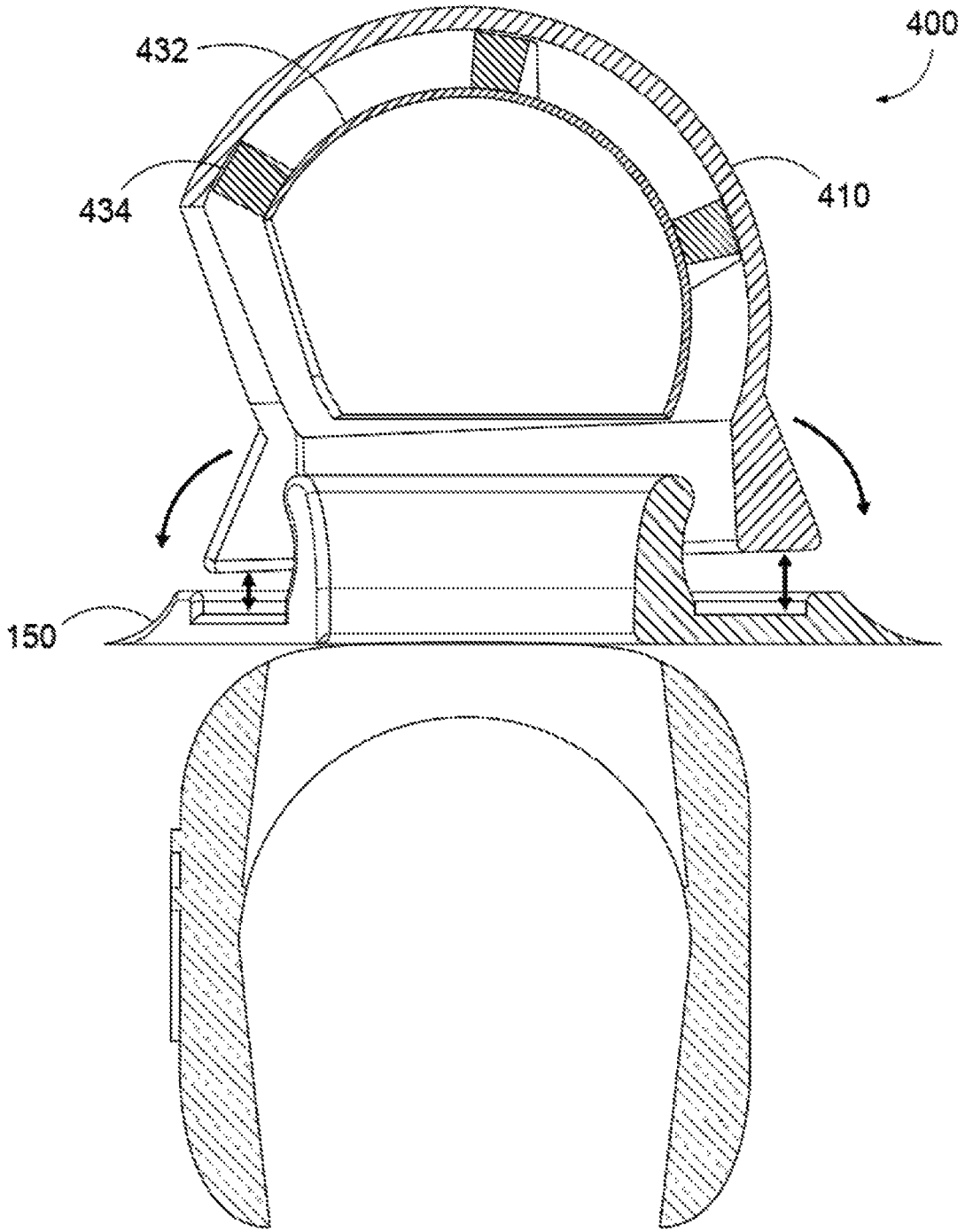
FIG. 11 is a side elevational view, in section of an energy absorbing head protection assembly device according to another exemplary embodiment of the present invention.
Figure 12:
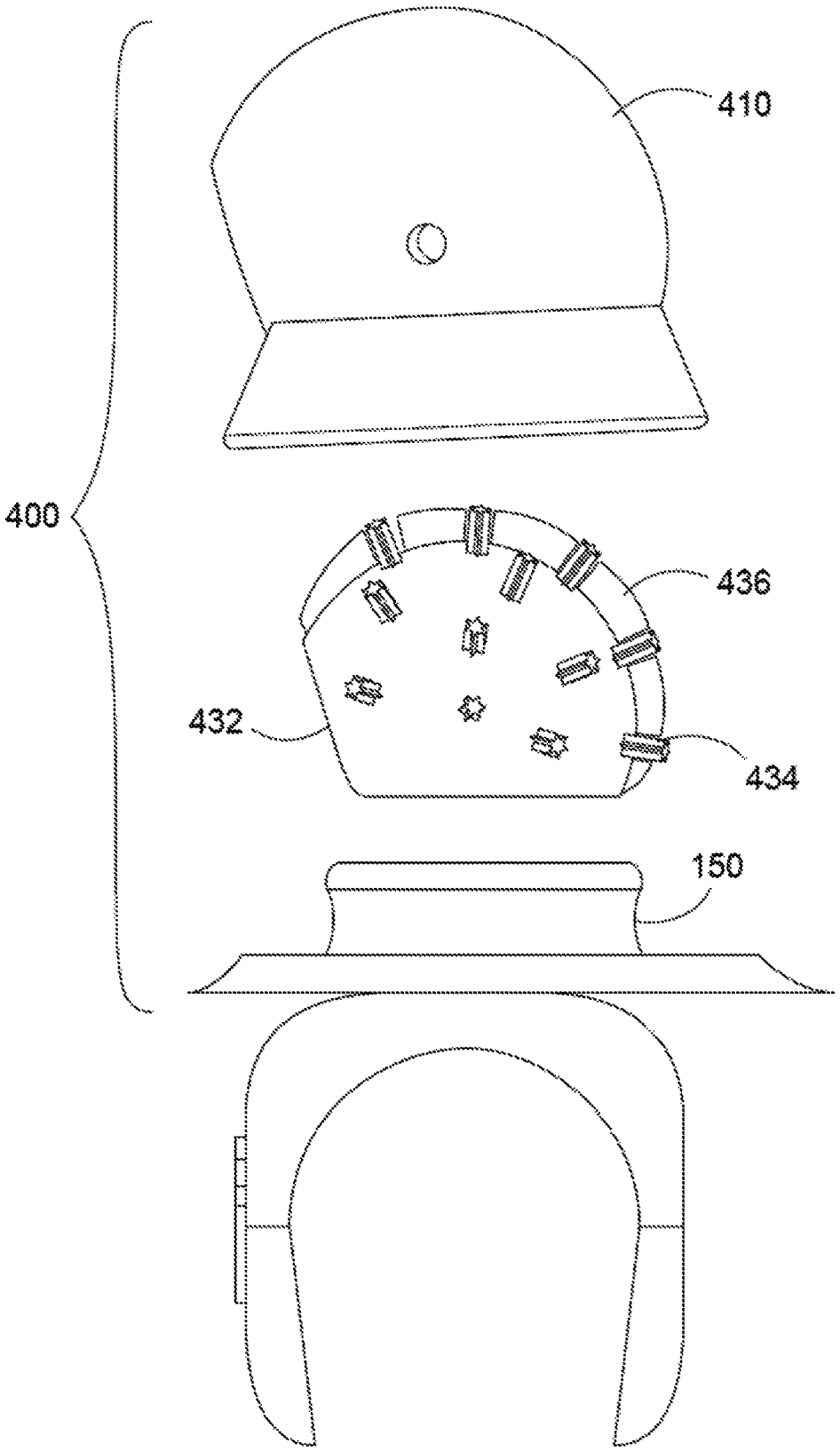
FIG. 12 is an exploded side elevational view of another energy absorbing head protection assembly device according to an alternative exemplary embodiment of the present invention.
Figure 13:
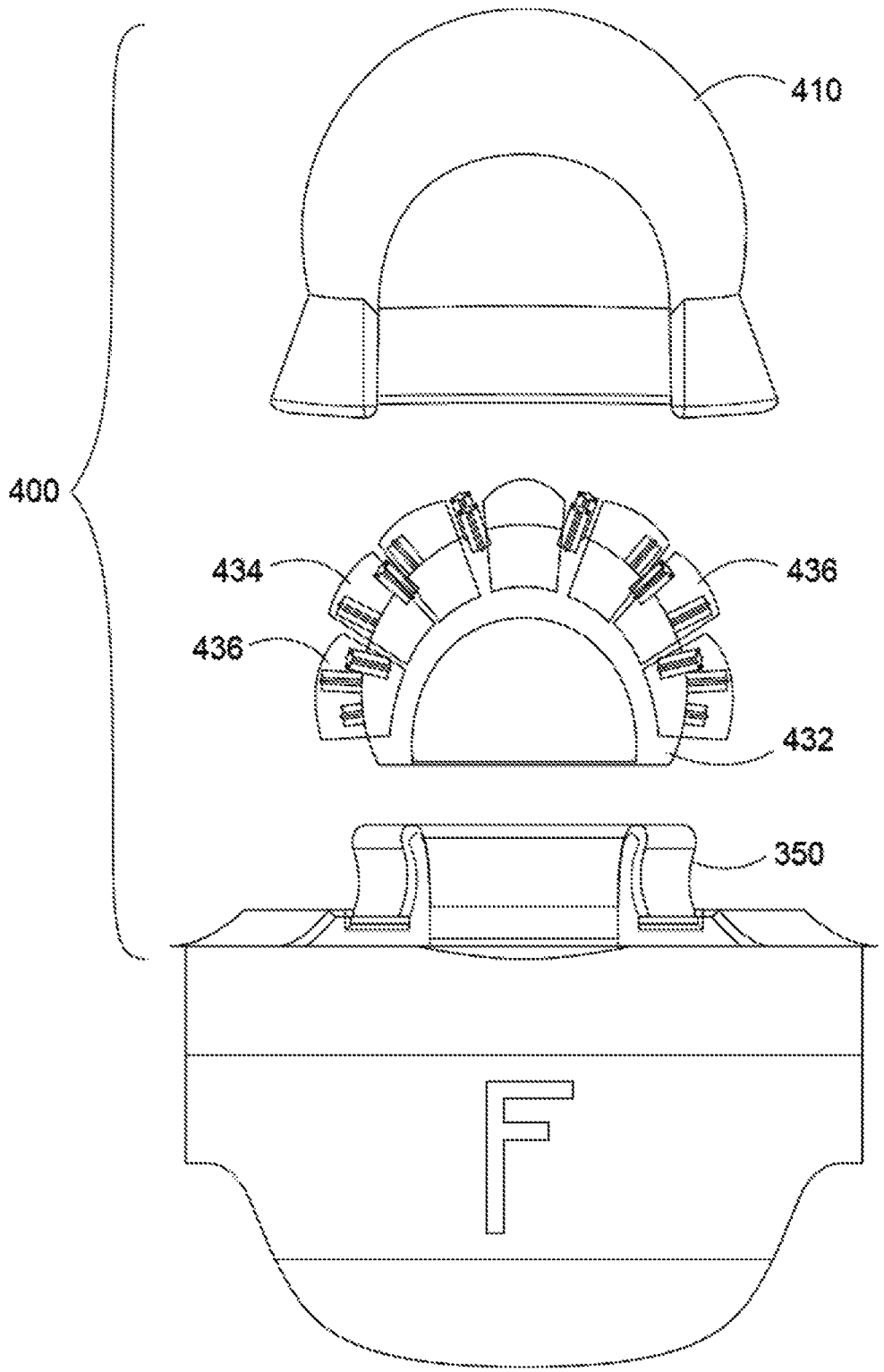
FIG. 13 is a front elevational exploded view of the device of FIG. 12.
Figure 14:
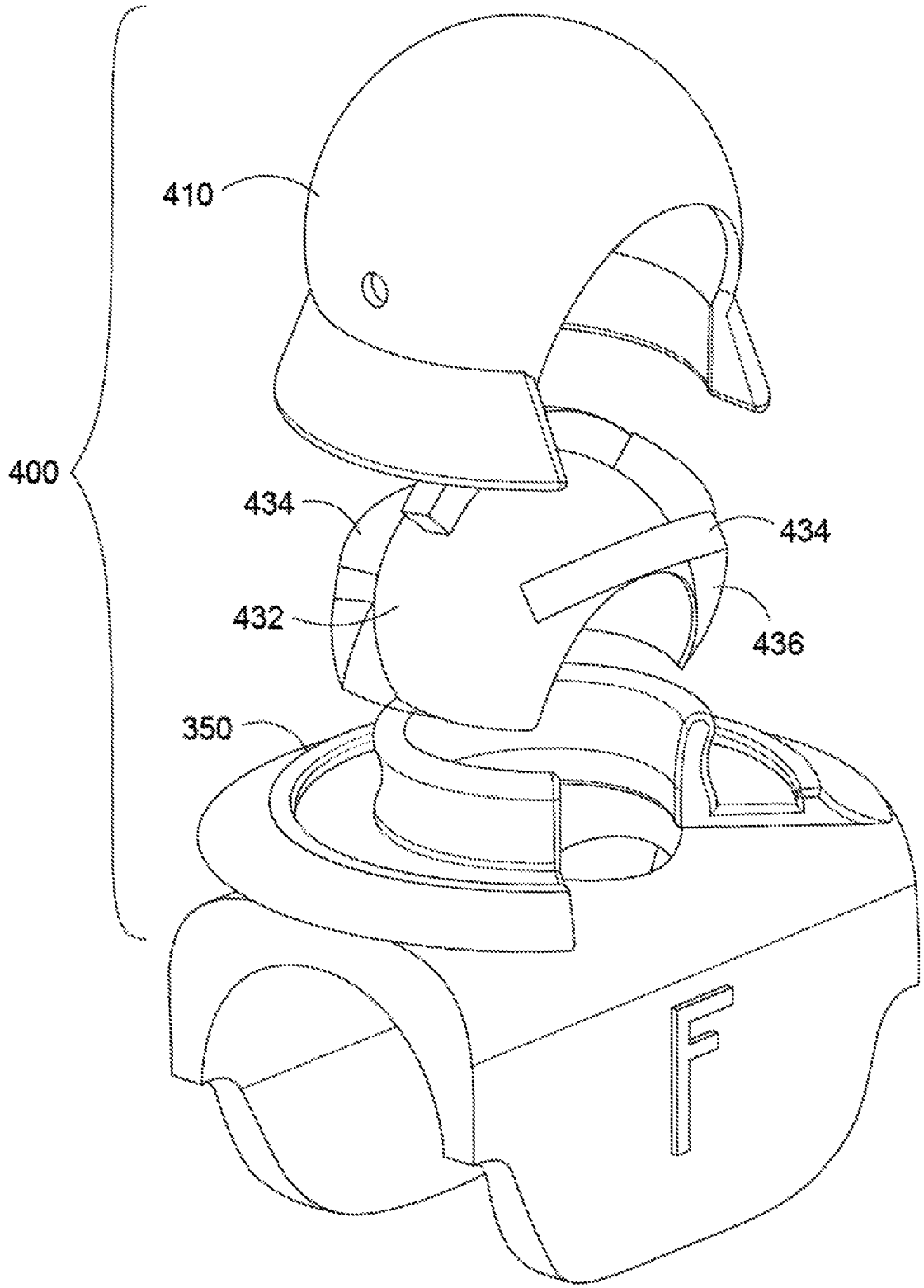
FIG. 14 is a perspective exploded view of the device of FIG. 12.

The collar portion can be collar portion 150 or olare portion 350 (collar portion 150 is shown in FIGS. 11-12 and collar portion 350 is shown in FIGS. 13-14)

In an exemplary embodiment, a compressive barrier 436 between the energy absorbing devices 434 can be an air bladder, although those skilled in the art will recognize that the compressive barrier 434 can be open cell foam, closed cell foam, or other suitable compressive material. Compressive barrier 426 can be air bladders to control compression forces.

It will be further understood that various changes in the details, materials, and arrangements of the parts which have been described and illustrated in order to explain the nature of this invention may be made by those skilled in the art without departing from the scope of the invention as expressed in the following claims.

What is claimed is:

1. A head protection device, comprising:

a head cradle portion comprising a sleeve extending upwardly from the seat;

an inner shell located within the head cradle portion, the inner shell having an inner shell lip wrapped around a portion of the outer shell, wherein the inner shell comprises an energy absorbing material;

a compressive barrier in engagement with the head cradle portion and the inner shell; and a force transfer/energy absorbing collar portion, wherein the collar portion comprises a seat adapted to engage the flange;

wherein the head cradle portion is spaced from adjacent and out of contact with the collar portion in normal operation and in contact with the collar portion upon impact of predetermined force, transferring the force and associated energy around the head cradle portion and dissipating the energy.

2. The head protection device according to claim 1, wherein the head cradle portion comprises:

a generally spherical upper portion having an open face portion; and a flange connected to the upper portion and extending in an arcuate direction around the upper portion.

3. The head protective device according to claim 2, wherein the flange flares outwardly from the upper portion.

4. The head protective device according to claim 1, wherein the sleeve is located within a perimeter defined by the flange.

5. The head protective device according to claim 4, wherein the flange comprises a flange rib extending radially inwardly and wherein the sleeve comprises a sleeve rib extending radially outwardly above the flange rib.

6. The head protective device according to claim 1, wherein the sleeve comprises a plurality of segments.

7. The head protective device according to claim 1, wherein the collar portion comprises a shoulder portion extending outwardly therefrom.

8. The head protective device according to claim 1, wherein the compressive barrier comprises an air bladder.

9. A head protective device comprising:

a collar portion comprising:

a seat extending in an arc of greater than 180 degrees;

a sleeve extending upwardly from the seat within the arc; and a shoulder portion extending outwardly from the seat; and a head cradle portion comprising:

a generally spherical upper portion having an open face portion;

an outer shell having a flange extending downwardly and flared outwardly therefrom, the flange extending in an arcuate direction around the upper portion, wherein the flange is adapted to engage the seat;

an inner shell located within the outer shell;

an energy absorbing device in engagement with the outer shell and the inner shell.

10. The head protective device according to claim 9, wherein the sleeve comprises a plurality of segments.

11. The head protective device according to claim 9, wherein the sleeve comprises an outer sleeve fixedly connected to the seat and an inner sleeve having a lip wrapped around a portion of the outer sleeve.

12. The head protective device according to claim 9, further comprising an energy absorbing material mounted on the seat.

13. The head protective device according to claim 9, wherein the inner shell has a lip wrapped around a portion of the outer shell.

14. The head protective device according to claim 13, wherein the lip is located proximate to the seat.

15. The head protective device according to claim 9, wherein the energy absorbing device comprises an air bladder.

16. A head protective device comprising:

a head cradle portion comprising:

a generally spherical upper portion having:

an open face portion; and an outer shell having a flange extending downwardly and flared outwardly therefrom;

the flange being connected to the upper portion and extending in an arcuate direction around the upper portion, the flange having a flange rib extending radially inwardly; and an inner shell having an inner shell lip wrapped around a portion of the outer shell, wherein the inner shell comprises an energy absorbing material; and a force transfer/energy absorbing collar portion comprising:

an outer sleeve fixedly connected to a seat;

an inner sleeve having an inner sleeve lip wrapped around a top portion of the outer sleeve such that the inner sleeve lip extends above the inner shell lip; and an energy absorbing material attached to the seat;

wherein the flange flares outwardly from the upper portion, and wherein the head cradle portion is spaced from adjacent and out of contact with the collar portion in normal operation and in contact with the collar portion upon impact of predetermined force, transferring the force and associated energy around the head cradle portion and dissipating the energy.

17. The head protective device according to claim 16, wherein the energy absorbing material comprises an air bladder.

18. The head protective device according to claim 16, wherein the head cradle portion is separate from the force transfer/energy absorbing collar portion.

* * * * *